United States Patent [19]

Rutledge

[11] Patent Number: 5,045,042

[45] Date of Patent: Sep. 3, 1991

[54] PLASTIC FILM BAG WITH INTEGRAL PLASTIC FILM TIE ELEMENT, AND ASSOCIATED FABRICATION METHODS

[75] Inventor: Gary L. Rutledge, Dallas, Tex.

[73] Assignee: John C. Marrelli, Tustin, Calif.

[21] Appl. No.: 381,105

[22] Filed: Jul. 17, 1989

Related U.S. Application Data

[62] Division of Ser. No. 117,209, Nov. 4, 1987, Pat. No. 4,854,735.

[51] Int. Cl.[5] ..... B31B 23/74; B31B 23/90

[52] U.S. Cl. ..... 493/225; 493/196; 493/194; 493/215

[58] Field of Search ..... 493/194–197, 493/203, 206, 209, 214, 215, 221, 223, 224, 225, 226, 341, 345, 380

[56] References Cited

U.S. PATENT DOCUMENTS

| | | | |
|---|---|---|---|
| 492,071 | 2/1893 | Fastener . | |
| 893,759 | 1/1908 | Thomas . | |
| 1,181,148 | 5/1916 | Linton . | |
| 2,281,964 | 5/1942 | Wolf | 493/223 |
| 2,849,171 | 8/1958 | O'Brien | 229/63 |
| 2,920,670 | 1/1960 | Mohlmann | 150/5 |
| 2,980,314 | 4/1961 | Adams | 229/65 |
| 3,285,309 | 11/1966 | Northcott | 150/11 |
| 3,412,926 | 11/1968 | Bostwick | 229/62 |
| 3,418,461 | 12/1969 | Paxton | 206/56 |
| 3,633,247 | 1/1972 | Clayton | 24/30 |
| 3,653,584 | 4/1972 | Lake | 229/53 |
| 3,662,434 | 5/1972 | Clayton | 241/30 |
| 3,664,575 | 5/1972 | Lake | 229/62 |
| 3,679,126 | 7/1972 | Lake | 229/62 |
| 3,716,182 | 2/1973 | Korn | 229/62 |
| 3,752,388 | 8/1973 | Lynch | 229/54 |
| 3,865,303 | 2/1975 | Korn | 229/62 |
| 3,889,872 | 6/1975 | Lin | 229/63 |
| 3,974,960 | 8/1976 | Mitchell | 229/62 |
| 3,982,687 | 9/1976 | Auer et al. | 229/62 |
| 4,008,851 | 2/1977 | Hirsch | 229/62 |
| 4,077,562 | 3/1978 | Ballin | 229/62 |

(List continued on next page.)

FOREIGN PATENT DOCUMENTS

| | | | |
|---|---|---|---|
| 878245 | 8/1971 | Canada | 493/203 |
| 47-32722 | 12/1972 | Japan . | |
| 48-10817 | 2/1973 | Japan . | |
| 51-33129 | 11/1976 | Japan . | |
| 53-30413 | 3/1978 | Japan . | |
| 53-51822 | 5/1978 | Japan . | |
| 54-94978 | 7/1979 | Japan . | |
| 55-139053 | 10/1980 | Japan . | |
| 55-150751 | 10/1980 | Japan . | |
| 56-36602 | 4/1981 | Japan . | |

(List continued on next page.)

*Primary Examiner*—Frederick R. Schmidt
*Assistant Examiner*—Jack Lavinder
*Attorney, Agent, or Firm*—Hubbard, Thurman, Tucker & Harris

[57] ABSTRACT

A series of bags are fabricated using a continuous, high-speed bag-forming process in which an elongated section of flattened film tubing is longitudinally conveyed toward a receiving station in which the formed bags are suitable packaged. As the flattened tube is moved toward the receiving station, elongated plastic film tie elements are sequentially formed and welded along relatively large area end portions thereof to at least two layers of a side edge portion of the flattened tube at longitudinally spaced locations thereon adjacent the upper end locations of the individual bags, the resulting free end portions of the tie elements overlying the flattened tube. Each of the resulting integral tie elements may be looped around an upper end portion of its associated bag and then firmly pulled to close the bag, the resulting loop being tightened either by first passing the free end portion of the tie element therethrough or by first passing the free end portion through an aperture formed in the tie element-bag weld area. In either case the relatively large, multiple layer weld area which secures the tie element to a side edge portion of its bag provides sufficient strength so that separation of the tie element from its bag, during tightening of the loop around the upper bag end, is effectively prevented.

21 Claims, 7 Drawing Sheets

U.S. PATENT DOCUMENTS

| | | | |
|---|---|---|---|
| 4,445,230 | 4/1984 | Spadaro | 383/7 |
| 4,753,538 | 6/1988 | Jordá | 383/8 |
| 4,778,283 | 10/1988 | Osborn | 383/71 |
| 4,786,189 | 11/1988 | Broderick et al. | 383/75 |
| 4,786,191 | 11/1988 | Broderick et al. | 383/75 |
| 4,792,241 | 12/1988 | Broderick et al. | 383/75 |
| 4,813,794 | 3/1989 | Herrington | 383/75 |

FOREIGN PATENT DOCUMENTS

| | | |
|---|---|---|
| 56-100401 | 8/1981 | Japan . |
| 61-178850 | 8/1986 | Japan . |
| 61-144043 | 9/1986 | Japan . |
| 62-33540 | 2/1987 | Japan . |
| 62-95546 | 6/1987 | Japan . |
| 62-4062 | 10/1987 | Japan . |
| 63-57247 | 4/1988 | Japan . |

PLASTIC FILM BAG WITH INTEGRAL PLASTIC FILM TIE ELEMENT, AND ASSOCIATED FABRICATION METHODS

This is a Divisional of application Ser. No. 117,209, filed Nov. 4, 1987 now U.S. Pat. No. 4,854,735.

BACKGROUND OF THE INVENTION

The present invention relates generally to plastic bags and their manufacture, and more particularly provides a plastic bag having an integral, ready-to-use plastic film tie element thereon which may be easily and quickly used to tightly close the bag, and associated methods for fabricating the bag and integral tie element structure.

A wide variety of closure devices are commonly used to close the upper ends of plastic bags such as the now-common plastic trash bag. These closure devices range from simple plastic clips or twist ties packaged separately from or removably connected to the individual bags, to relatively complex draw string-type devices in which portions of the bag itself, or a separate draw string element, must be laboriously threaded through multiple openings in the bag and then pulled to close the upper bag end.

Conventional bag closure devices of these and various other types suffer from one or more of the following disadvantages and limitations:

1. They are relatively expensive to manufacture and/or attach to the bags in the bag manufacturing process;
2. They are separate from the bag and are thus easily lost;
3. They are difficult to use, particularly by persons with only limited manual dexterity;
4. They must be removed from the bag and then reoriented and manipulated to effect bag closure;
5. They are relatively thick and stiff and, if attached to the bags during formation thereof, can potentially interfere with both the bag-forming and bag-packaging processes;
6. They undesirably delay the bag-forming process;
7. They cannot be firmly pulled, to effect tight bag closure, without potentially damaging the bag and/or the closure device, or causing separation of the closure device from its associated bag; and
8. They are of only marginal effectiveness in maintaining firm bag closure.

It is accordingly an object of the present invention to provide a plastic bag and integral closure element structure, and associated manufacturing methods therefor, which eliminates or minimizes above-mentioned and other disadvantages and limitations commonly associated with conventionally constructed plastic bag and closure element combinations.

SUMMARY OF THE INVENTION

In carrying out principles of the present invention, in accordance with a preferred embodiment thereof, a continuous high speed bag making process is used to fabricate a series of plastic bags with integral, ready-to-use plastic film top tie elements. Each of the bags has an open upper end, a closed lower end, a pair of opposite side edge portions defined by a plurality of plastic film layers, and a pair of opposite side walls interconnecting the side edge portions and the lower end.

To tie off an upper end portion of the bag, an elongated plastic film tie element is permanently secured thereto during the bag forming process. A relatively large end portion area of the tie element and at least two layers of one of the bag's side edge portions adjacent its upper end are weldingly intersecured, thereby leaving an elongated free end portion of the tie element which is in a ready-to-use position for tying off the upper bag end. Rapid and very tight closure of the bag may be effected simply by passing the tie element free end portion around a gathered upper end portion of the bag to form a tightening loop. The free end portion of the tie element is then passed through such loop and firmly pulled to tighten the loop around the upper bag end portion. Importantly, the multi-layer plastic weld area which secures the fixed end portion of the tie element to a side edge portion of the bag provides a sufficient tie-bag attachment strength to permit a very firm loop tightening pull on the tie element without causing the tie element to be separated from the bag.

According to a feature of the present invention, a suitable aperture, preferably an elongated slit, may be formed through the relatively large fixed end portion of the tie element and the side edge layers of the bag to which it is welded. A heated knife element may be used to form the aperture to form a fused ridge around its periphery, thereby reinforcing the aperture and inhibiting tearing thereof. To tie off the top of the bag, the free end portion of the tie element is passed around the gathered top end portion of the bag to form a tightening loop around it. However, instead of then passing the free end portion through the tightening loop which it has created, the free end portion is passed through the weld area aperture and then firmly pulled to tighten the loop and securely close the upper end of the bag.

The aperture is preferably made sufficiently small relative to the width of the tie element free end portion so that as the free end portion is initially pulled through the aperture it is laterally deformed and gathered by the aperture to inhibit reverse movement of the free end portion therethrough. This, in turn, assists in preventing loosening of the tightening loop.

The elongated plastic film tie element may be given a variety of alternate configurations and is formed from one or more strips of relatively thin plastic film material. The tie element has a thickness which is preferably only about two or three times that of the film thickness of the bag itself. Accordingly, the tie elements are considerably stronger than the bag film, but are still quite thin, pliable and unobtrusive.

In one embodiment thereof, the tie element is formed from a single elongated strip of suitable plastic film material. This strip may be of a single plastic film material, or may be a dual layer plastic film coextrusion, one of the layers being of a relatively stiff plastic film material, such as high density polyethylene, while the other layer is of a plastic film material, such as ethyl vinyl acetate or other suitable broad sealing temperature range polymer material, which is more flexible, but is more easily weldable as well and has a higher coefficient of friction to enhance the overall bag closure retention capability of the tie element. The use of this coextruded strip permits a large area end portion of its readily weldable layer to be welded to the bag side edge portion, while its stiffer outer layer improves the ability of the tie element to maintain the bag in its closed position. This is particularly true when the weld area aperture is used. When the free end portion of the coextruded strip is pulled through the aperture, and laterally gathered and compressed thereby, the stiffer strip layer portion which has been pulled through the aperture tends to spring back toward its original width, thereby inhibiting reverse movement of the strip through the aperture.

In another version of the tie element, the plastic film strip used to form such element is doubled over onto itself so that the resulting tie element free end portion has a looped configuration. When the tie element is looped around the gathered top end portion of the bag and pulled through the tightening loop, or the weld area aperture as the case may be, the outer end of the free end portion defines a convenient carrying loop through which one or more fingers may be inserted to conveniently carry the closed bag.

In another embodiment of the tie element, two separate plastic film strips are used so that the free end portion of the tie element is defined by the two free end portions of such strips. In this tie element embodiment, which is utilized in conjunction with the weld area aperture, one of the separate strips is passed around the gathered upper end portion of the bag and then run through the weld area aperture. The outer ends of the separate strips are then grasped and then firmly pulled in opposite directions to close the bag.

In the bag forming process used to fabricate the plastic bag and integral tie element structure of the present invention, an elongated plastic film element (preferably a flattened plastic film tube) is longitudinally conveyed toward a suitable bag packaging station. The plastic film element has a pair of opposite side walls, and a pair of opposite side edge portions each defined by a plurality of plastic film layers. The individual bags are formed on the moving plastic film element by suitable bag-forming apparatus which forms on the plastic film element appropriately positioned cutlines which define the bottom and top ends of adjacent bags in the series thereof being formed, and weld lines which close off the bottom ends of the bags.

To rapidly form the tie elements and sequentially secure them to the individual bags, a tie element attachment station is positioned adjacent one of the side edge portions of the moving plastic film element. Suitable plastic film strip material is fed to a first portion of the station from one or more strip supply rolls. The first station portion is operated to sever an appropriate length of the film strip material which it receives and preheat or weld an end portion of the severed strip material. The severed, preheated strip material is then positioned over the side edge portion of the plastic film element and its preheated end portion is welded to such side edge portion adjacent what is or will be the upper end of one of the bags.

Alternatively, the plastic film strip material may be fed to a combination forming and welding station positioned at one of the side edge portions of the plastic film element. This alternate station simultaneously severs the received plastic film strip material and welds an end portion thereof to the appropriate section of the side edge portion of the plastic film element.

The integral plastic film tie elements provided on each of the rapidly formed individual bags eliminate or minimize most if not all of the limitations and disadvantages typically associated with conventional plastic bag closure devices. They are quite inexpensive to manufacture and attach to the bags. Because they are permanently affixed to their associated bags they cannot be lost or misplaced. The tie elements are at all times in a ready-to-use position, they do not have to be removed from their associated bag to be used, and they are quite easy to use. Since the tie elements are of a thin plastic film material, they do not interfere with or appreciably slow either the bag forming or bag packaging process. Additionally, because of the substantial, multi-layer weld area used to permanently secure the tie elements to side edge portions of their associated bags, the firm pull on the tie elements used to very effectively achieve tight closure of their bags does not damage either the bag or the tie element, and does not cause separation of the tie element from its associated bag. The tight bag closure capability provided by the tie elements in their various embodiments functions to very efficiently prevent the escape of liquids and/or odors from the sealed upper ends oI the bags.

DETAILED DESCRIPTION

Figure 1:
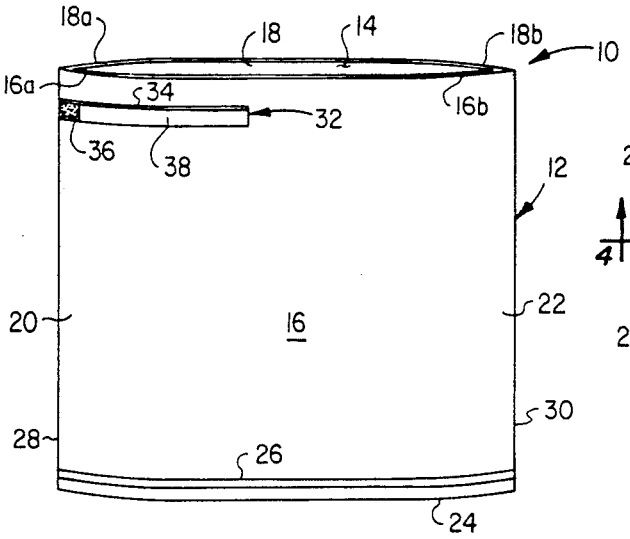
FIG. 1 is a perspective view of a plastic bag which embodies principles of the present invention and has a plastic film tie element fixedly secured at one end thereto to a side edge portion of the bag adjacent its open upper end.

Perspectively illustrated in FIG. 1 is a plastic bag and integral tie element structure 10 that embodies principles of the present invention. The structure 10 includes a plastic film bag 12 which, for illustrative purposes, is a large disposable trash bag that has an open upper end 14, front and rear side walls 16 and 18, left and right side edge portions 20 and 22, and a closed bottom end 24 defined by a transverse weld line 26 intersecuring the side walls 16 and 18 and extending between the left and right side edges 28 and 30 of the bag. The left side edge portion 20 of the bag is defined by laterally outer portions 16*a* and 18*a* of the side walls 16 and 18 immediately adjacent the left side edge 28, while the right side edge portion 22 of the bag is defined by laterally outer portions $16_b$ and $18_b$ of the side walls 16 and 18 immediately adjacent the right side edge 30 of the bag.

The structure 10 also includes a relatively thin plastic film tie element 32 which is fixedly secured to the bag in a ready-to-use form and is utilized in a manner subsequently described to very convenienty and rapidly effect a tight closure of an upper end portion of the bag. The tie element 32 comprises an elongated, single strip 34 of a relatively thin plastic film material having a thickness on the order of only about 2 to 3 times the thickness of the plastic film used to form the bag 12. The illustrated strip 34 is approximately one inch wide and approximately seven to eight inches long.

Figure 3:
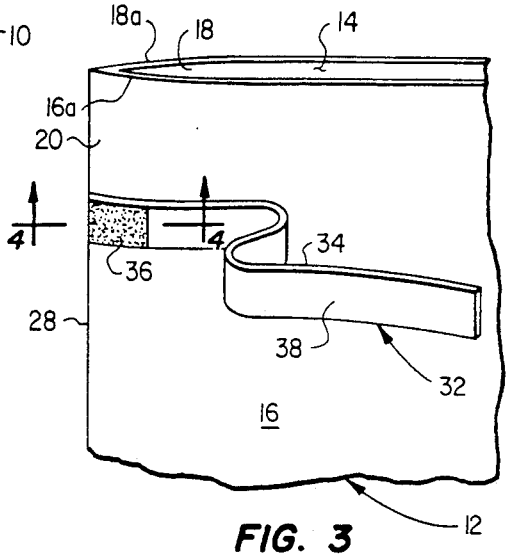
FIG. 3 is an enlarged perspective view of the tie element and an upper left corner portion of the bag to which it is fixedly secured.
Figure 4A:
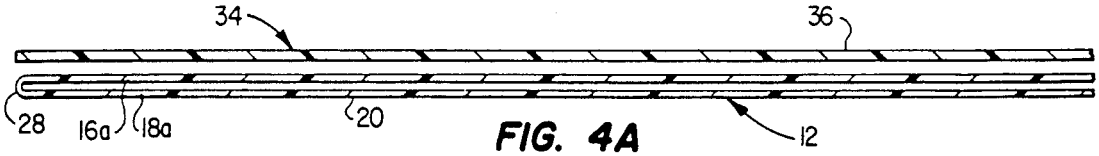
FIG. 4A is a greatly enlarged exploded cross-sectional view, taken along line 4—4 of FIG. 3, illustrating a left end portion of the tie element prior to being welded to an underlying side edge portion of the bag.
Figure 4B:
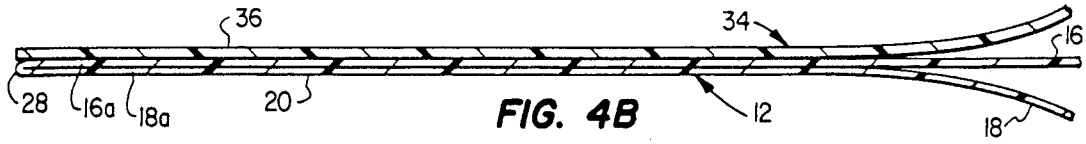
FIG. 4B is a view similar to that in FIG. 4A, but illustrates the left end portion of the tie element after welding thereof to the underlying side edge portion of the bag.

According to an important aspect of the present invention, the strip 34 has an end portion 36 which has a substantial area (approximately one square inch) and, in a manner subsequently described, is positioned over the left side edge portion 20 of the bag adjacent its upper end (see FIG. 4A) and is then secured to the bag by weldingly intersecuring the strip end portion 36 and the lateral side wall portions $16_a$ and $18_a$ as illustrated in FIG. 4B. For illustrative clarity, the welded strip end portion 36 has been stippled in FIGS. 1-3. Corresponding weld areas in subsequent drawing figures have also been stippled for illustrative purposes. As best illustrated in FIG. 1, the welding together of these three layers (i.e., the strip end portion 36 and the lateral bag side wall portions $16_a$ and $18_a$) positions the plastic film strip 34 so that an elongated free end portion 38 thereof extends transversely across the front bag side wall 16 toward the right side edge 30 of the bag.

Figure 2:
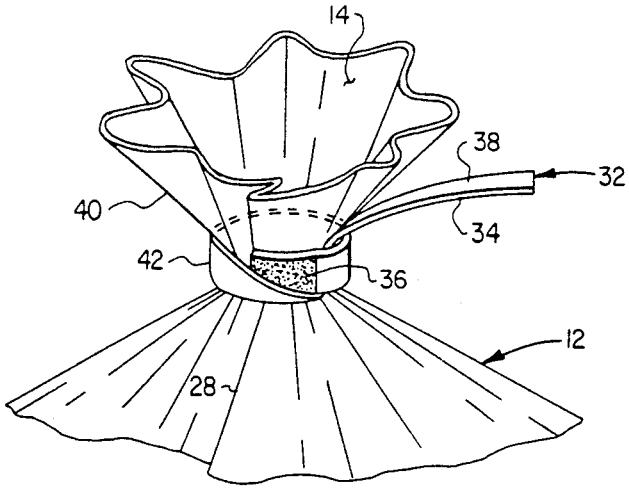
FIG. 2 is an enlarged scale fragmentary perspective view of an upper end portion of the bag illustrating the manner in which its integral tie element may be used to tightly close the upper end of the bag.

To rapidly close the bag 12, an upper end portion 40 of the bag is gathered adjacent the strip 34 and the free strip end portion 38 is wrapped around the gathered upper end portion to form a loop 42 therearound as illustrated in FIG. 2. The free end portion 38 is then passed through the loop 42 and firmly pulled to tighten the loop, thereby tightly closing the upper bag end. Importantly, the welding of the relatively large area strip end portion 36 to the two side edge layer portions of the bag secures the end portion 36 to the bag with sufficient strength so that firmly pulling the free strip end portion 38 to tightly cinch the loop 42 around the gathered upper end portion of the bag does not separate the strip end portion 36 from the bag—it remains securely affixed thereto.

Figure 4C:
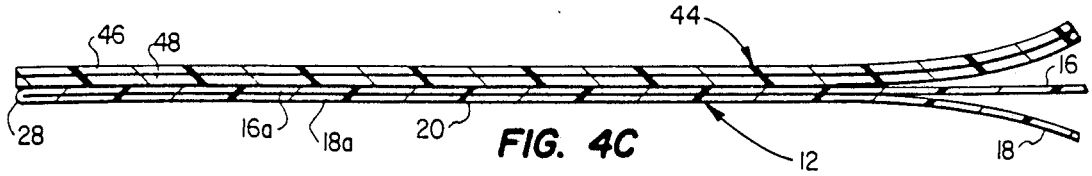
FIG. 4C is a view similar to that in FIG. 4B, but illustrates a coextruded version of the tie element.

Referring to FIG. 4C, the single plastic film strip 34 may be replaced, if desired, with a coextruded strip 44 having an outer layer 46 of a relatively stiff thin plastic film such as high density polyethylene, and an inner layer 48 of a more flexible plastic film material, such as ethyl vinyl acetate or other suitable broad sealing temperature range polymer material, which may be more easily welded to the bag and has a higher coefficient of friction than the outer layer to thereby enhance the overall bag closure retention capability of the tie element. The relative stiffness of the outer film layer 46 facilitates holding the cinched loop 42 (FIG. 2) in a closed position, while the more flexible inner layer 48 facilitates the welding of the strip 44 to the bag. The single film strip 34 previously described may be of a plastic film material which is both relatively easy to weld to the bag and provides at least some relative degree of stiffness to the strip.

Figure 5:
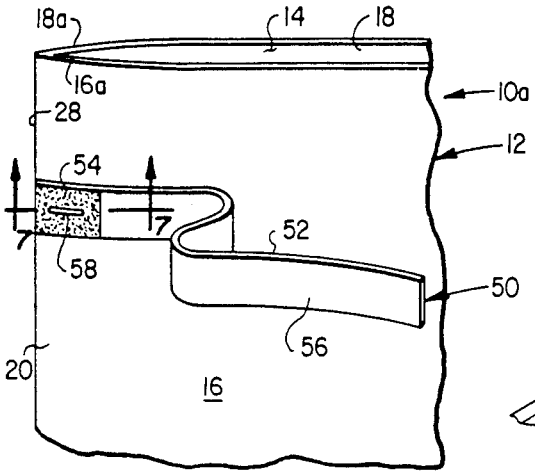
FIG. 5 is a perspective view of an alternate embodiment of the tie element secured to an upper left corner portion of the bag.
Figure 7:
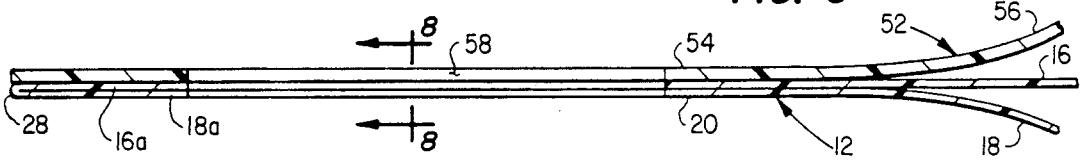
FIG. 7 is a greatly enlarged cross-sectional view taken along line 7—7 of FIG. 5.

Illustrated in FIG. 5 is an alternate embodiment $10_a$ of the bag and tie structure in which a modified tie element 50 is fixedly secured to a side edge portion of the bag 12 adjacent its upper end 14. The tie element 50 comprises a single, elongated strip 52 of relatively thin plastic film material which is similar to the previously described strip 34, or may be formed as a coextrusion like the strip 44 of FIG. 4C. The strip 52 has a relatively large area end portion 54 which, as illustrated in FIGS. 7 and 8, is welded to the lateral side wall portions $16_a$ and $18_a$ of the bag 12 as previously described in conjunction with the strip 34, thereby leaving an elongated free end portion 56 of the strip which extends transversely across the bag.

However, an elongated slit 58 (or other suitably configured opening) is formed entirely through the welded area defined by the strip end portion 58 and the sections of the lateral side wall portions $16_a$ and $18_a$ intersecured therewith. To tightly close the gathered upper end portion 40 of the bag 12, the free strip end portion 56 is wrapped around it to form a loop 60, and the free end portion 56 is then passed through the slit 58 and firmly pulled to tighten the loop 60 and close the bag.

Figure 6:
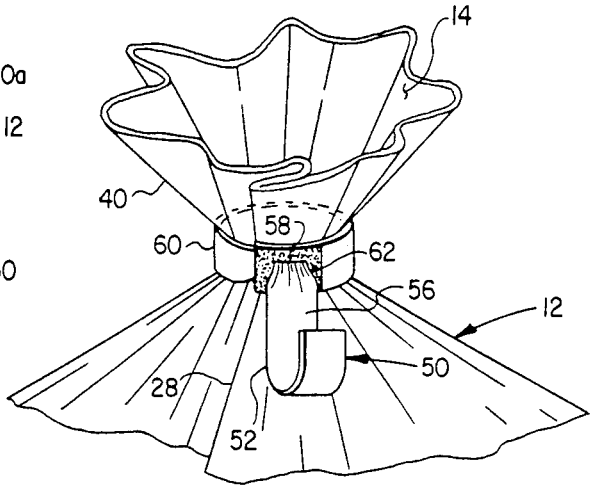
FIG. 6 is a perspective view of an upper end portion of the bag of FIG. 5 illustrating the manner in which its tie element may be used to tightly close an upper end portion of the bag.

The length of the slit 58 is at least somewhat shorter than the width of the strip 52 so that as the free strip end portion 56 is pulled through the slit 58 it is laterally foreshortened and gathered. Particularly when the coextruded version of the strip 52 is utilized, the part of the free end portion 56 which has been passed through the slit 58 tends to spring back to its normal width which is greater than the length of the slit 58 as indicated by the numeral 62 in FIG. 6. This rewidening of the free end portion 56 forms a natural restraint against the strip being pulled rearwardly through the slit, thereby tending to hold the loop 60 in its tightly sensed configuration. To augment this feature of the strip 52, small projections (not shown) may be formed on its free end portion 56 if desired, such projections forming "stops" to hinder widening of the loop 60.

Figure 8:
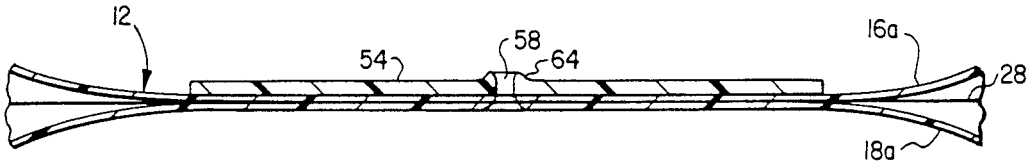
FIG. 8 is a cross-sectional view taken along line 8—8 of FIG. 7.

Referring now to FIG. 8, the elongated slit 58 may be conveniently formed by a heated slitting knife which, when passed through the interwelded bag-tie area, forms a laterally outwardly projecting area 64 of the strip end portion 54 which circumscribes and tends to reinforce the wall area surrounding the slit. This reinforced area around the slit 58 further restrains the free strip end portion 56 from being pulled rearwardly through the slit and loosening the tightening loop 60.

Figure 9:
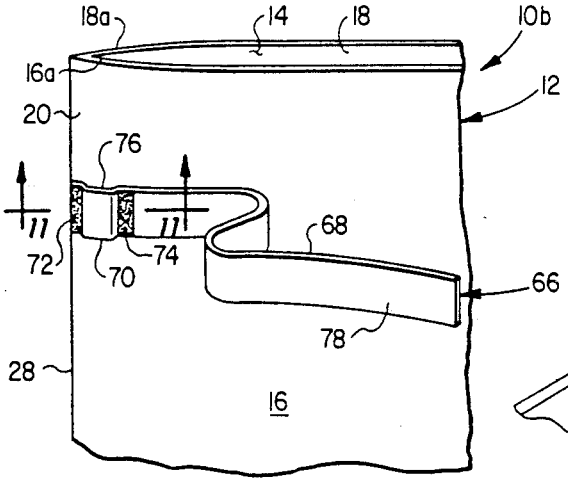
FIG. 9 is a perspective view of another alternate embodiment of the tie element secured to an upper left corner portion of the bag.
Figure 11:
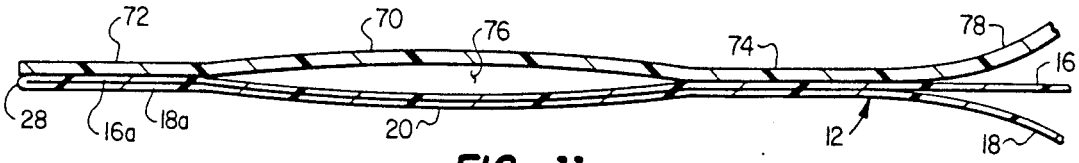
FIG. 11 is a greatly enlarged cross-sectional view taken along line 11—11 of FIG. 9.

Another alternate embodiment 10*b* of the bag and integral tie structure is depicted in FIG. 9. In this embodiment, a tie element 66, which comprises an elongated strip 68 of relatively thin plastic film material (which may be either a single layer or a coextruded construction as previously described) is fixedly secured to the bag 12 adjacent its upper end 14. The strip 68 has an end portion 70 which is welded to the side edge portion 20 of the bag 12 along longitudinally spaced sections 72 and 74 of the strip end portion 70 to define with the front side surface of the bag 12 a gap 76 (FIG. 11) extending between the welded strip portions 72 and 74.

Figure 10:
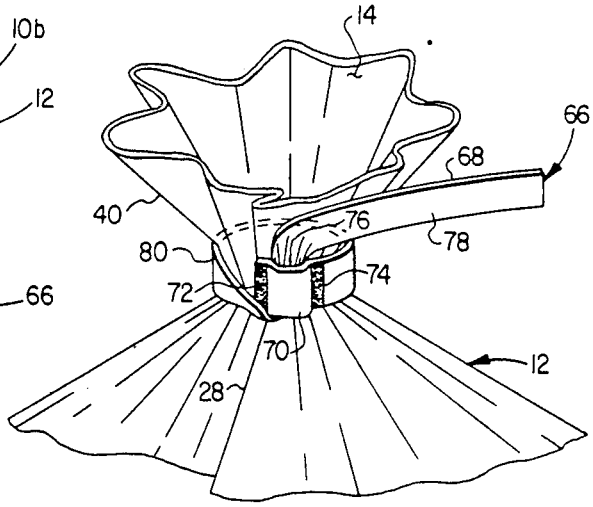
FIG. 10 is a perspective view of an upper portion of the bag of FIG. 9 illustrating the manner in which its tie element may be used to tightly close an upper end portion of the bag.

To tightly close the gathered upper end portion 40 of the bag 12 (FIG. 10) the free end portion 78 of the strip 68 is wrapped around the gathered upper end portion to form a tightening loop 80. The free end portion 78 is then passed through the gap 76 and firmly pulled to tighten the loop 80. The gap 76 may conveniently be configured so that its width (i.e., its left-to-right dimension in FIG. 11) is shorter than the width of the strip 68 so that the strip is laterally gathered within the gap 76 to inhibit the strip from being pulled rearwardly through the gap in a manner similar to that described in conjunction with the strip 52 in FIG. 6.

Figure 12:
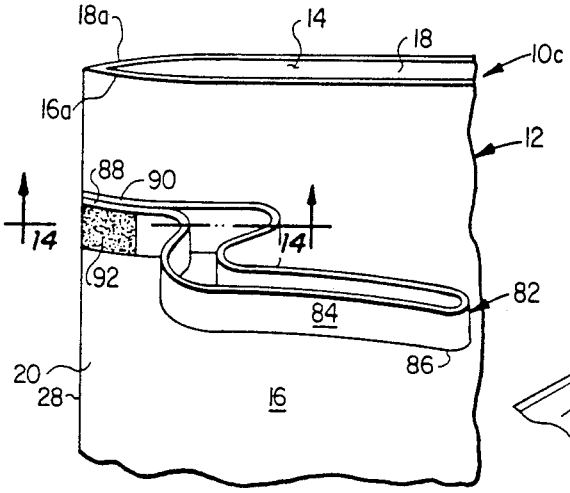
FIG. 12 is a perspective view of another alternate embodiment of the tie element secured to an upper left corner portion of the bag.
Figure 13:
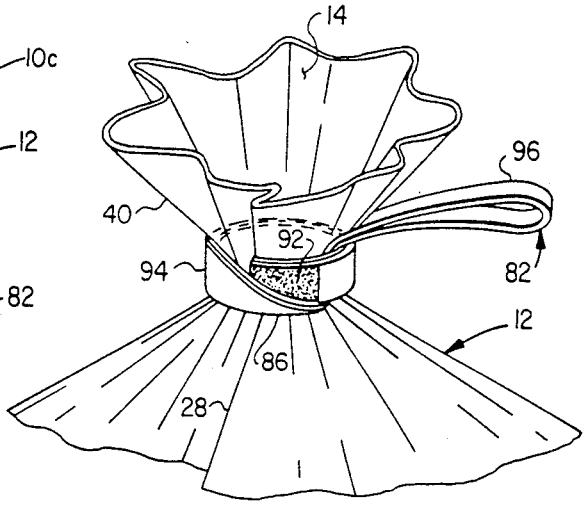
FIG. 13 is a perspective view of an upper end portion of the bag of FIG. 12 illustrating the manner in which its tie element may be used to tightly close an upper end portion of the bag.
Figure 14:
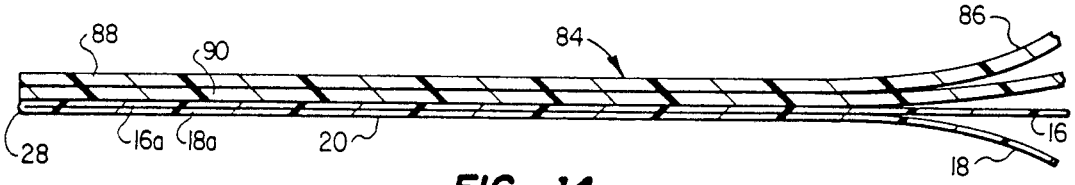
FIG. 14 is a greatly enlarged cross-sectional view taken along line 14—14 of FIG. 12.
Figure 15:
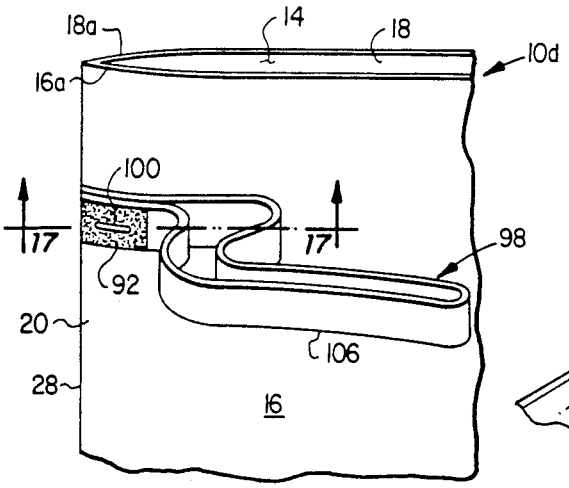
FIG. 15 is a perspective view of another alternate embodiment of the tie element secured to an upper left corner portion of the bag.
Figure 16:
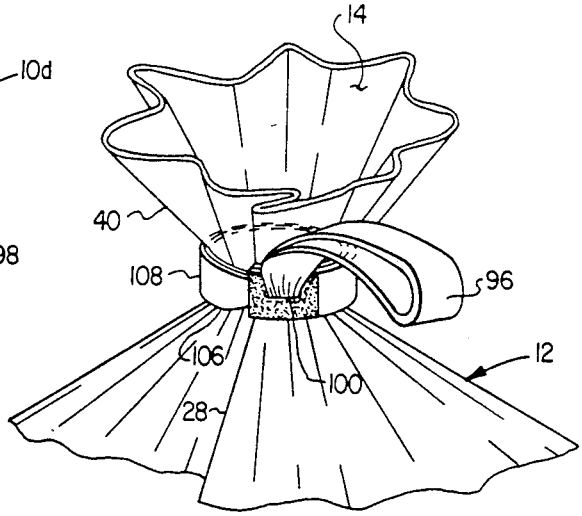
FIG. 16 is a perspective view of an upper portion of the bag of FIG. 15 illustrating the manner in which its tie element may be used to tightly close an upper end portion of the bag.

Two additional embodiments 10*c* and 10*d* of the bag and integral tie element structure are respectively depicted in FIGS. 12 and 15. The tie element 82 shown in FIG. 12 is formed from an elongated single strip 84 of relatively thin plastic film material which is doubled over onto itself to form a looped free end portion 86 of the tie element, while outer end portions 88 and 90 of the strip (see also FIG. 14) are welded to each other and to the side edge portion 20 of the bag 12 adjacent its upper end, thereby forming a welded area 92 having four separate layers. To tightly close the gathered upper end portion 40 of the bag 12, the looped free end portion 86 of the tie element 82 is passed around the gathered upper end portion to form a tightening loop 94 and then passed through the loop 94. The looped end portion 86 is then firmly pulled to tighten the loop 94. It can be seen in FIG. 13 that after such tightening, an outer end section of the looped portion 86 defines a small carrying loop 96 through which one or more fingers may be inserted to conveniently carry the closed bag.

Figure 17:
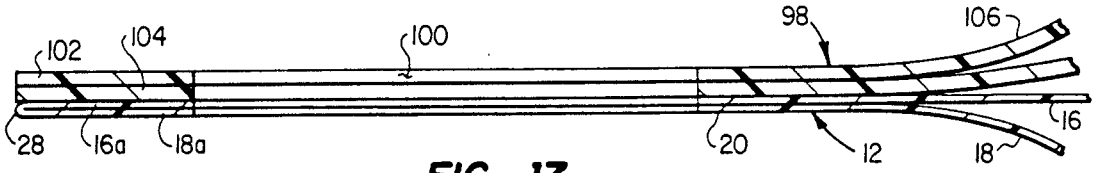
FIG. 17 is a greatly enlarged cross-sectional view taken along line 17—17 of FIG. 15.

In the alternate embodiment $10_d$ of the bag and integral tie structure depicted in FIG. 15, a looped tie element 98 is provided which is similar to the tie element 82 of FIG. 12 except that the welded area 92 has an elongated slit 100 (or other suitably configured opening) formed therethrough, the slit 100 passing through the aligned outer end portions 102 and 104 of the tie element 98, and the side edge portion 20 of the bag 12 as depicted in FIG. 17. To close the gathered upper end portion 40 of the bag 12, the looped free end portion 106 of the tie element 98 is passed around the gathered upper end portion to form a tightening loop 108. The looped free end portion 106 is then passed through the slit 100 and firmly pulled to tighten the loop 108. In a manner similar to that described in conjunction with FIG. 13, this final step in the bag closing process provides a small carrying loop 96 by means of which the closed bag may be conveniently carried simply by inserting one or more fingers into the loop 96.

Figure 18:
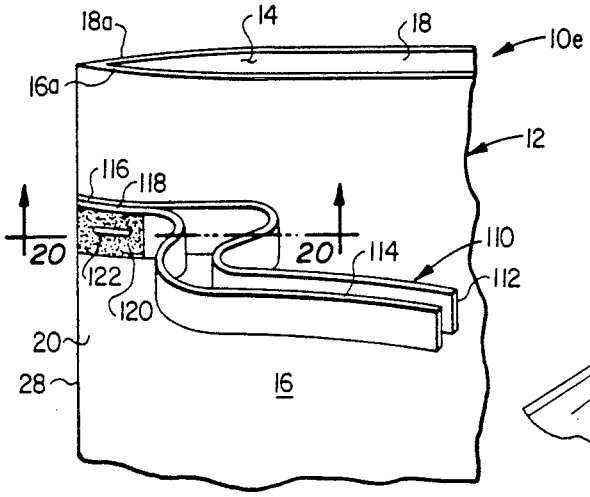
FIG. 18 is a perspective view of another alternate embodiment of the tie element secured to an upper left corner portion of the bag.
Figure 19:
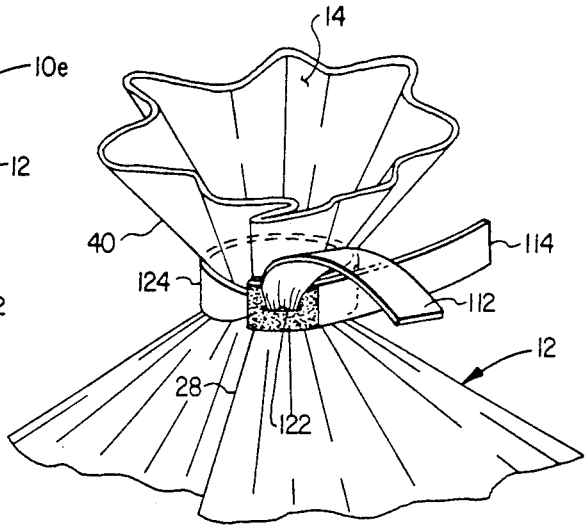
FIG. 19 is a perspective view of an upper portion of the bag of FIG. 18 illustrating the manner in which its tie element may be used to tightly close an upper end portion of the bag.
Figure 20:
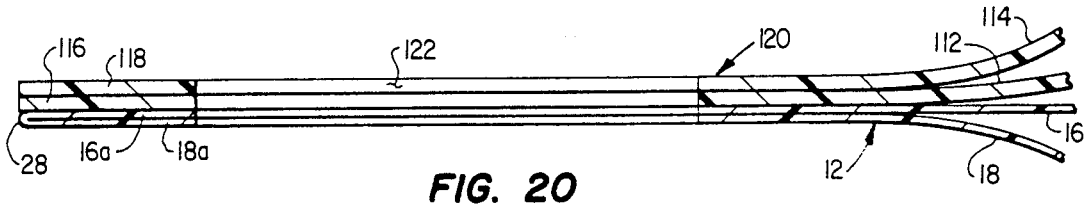
FIG. 20 is, a greatly enlarged cross-sectional view taken along line 20—20 of FIG. 18.

A further embodiment 10*e* of the bag and integral tie element structure is illustrated in FIG. 18 and is provided with tie element 110 which is substantially identical to the tie element 98 depicted in FIG. 15 except that the free end portion of the tie element 110 does not have a looped configuration. Instead, such free end portion is defined by inner and outer strip sections 112 and 114 having aligned inner end portions 116 and 118 which are welded to each other and to the side edge portion 20 of the bag adjacent its upper end to form a welded area 120 through which an elongated slit 122 is formed as depicted in FIG. 20. To close the gathered upper end portion 40 of the bag 12, the inner strip section 112 is passed around the gathered upper end portion to form a tightening loop 124 (FIG. 19) and then is passed through the slit 122. The strip sections 112 and 114 are then firmly pulled in opposite directions to tighten the loop 124.

Figure 21:
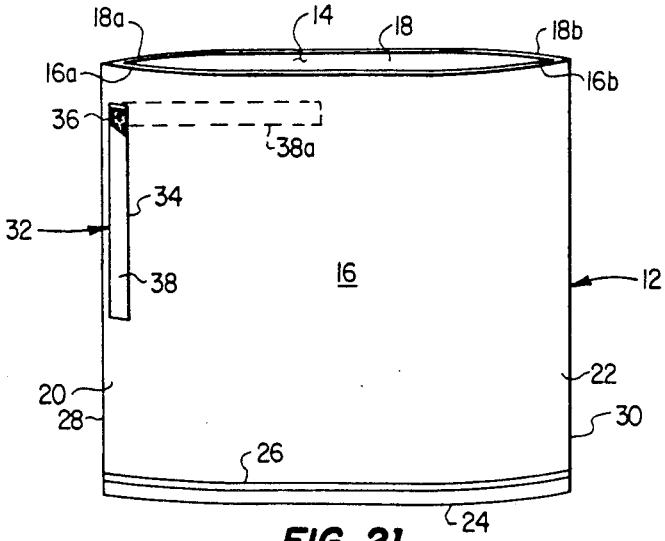
FIG. 21 is a perspective view of the bag having a further alternate embodiment of the tie element secured thereto.

While each of the previously described tie element embodiments has been illustrated as being welded to the bag in a manner such that the free end portion of the particular tie element extends transversely to the side edge portions of the bag, any of these tie element embodiments could be alternatively secured to the bag so that the tie element extends generally parallel to one of the side edge portions of the bag. For example, as depicted in FIG. 21, the tie element 32 of FIG. 1 could have its welded strip end portion 36 secured to the side edge portion 20 of the bag 12 adjacent its top end 14 so that the free end portion 38 of the strip extends parallel to the side edge 28 of the bag. To close the gathered end portion of the bag 12, the free end portion 38 of the strip 34 would simply be moved to the horizontal, dotted line position 38*a* and then wrapped around the gathered upper end portion of the bag as previously described. To facilitate the reorientation of the free strip end portion 38 to its transverse, dotted line position 38*a*, the welded area 36 could be given a generally triangularly shaped configuration as illustrated in FIG. 21.

The variety of alternate tie element embodiments just described have in common an important feature of the present invention—namely the welding of a relatively large area end portion of the tie element to a side edge portion of its associated bag positioned adjacent its open upper end. More specifically, these relatively large area end portions of the tie elements (whether they are defined by single or double layers of plastic film material), and portions of the opposite plastic film layers which define a side edge portion of the bag, are weldingly intersecured to form a bag-tie element interconnection of sufficient strength to permit the free end portion of the particular tie element to be firmly pulled to tighten a loop around the gathered upper end portion of the bag, to tightly close it, without causing separation of the tie element from the bag side edge portion at the welded area.

This feature is of particular importance in the tie element embodiments in which the free end portion of the tie element is simply passed through the tightening loop which such free end defines. In these instances, the tightening pull on the free end portion of the tie element exerts a force directly against the welded area in a manner tending to separate the tie element portion of such welded area from the bag portion thereof. However, by welding the tie element to the side edge portion of the bag in the previously described manner, this weld joint is made of sufficient strength to prevent separation of the tie element from the bag side edge portion during this important tightening process.

In this regard it should be noted that even in the tie element embodiments which incorporate the slit formed through the tie element-bag welded area, the bags may be alternately closed without passing the free end portion of the tie element through its provided slot or other aperture in the weld area. Instead, the free end portion of such tie elements may simply be wrapped around the gathered upper end portion of the bag to form a tightening loop and then passed through such tightening loop without using the aperture, if desired.

The plastic bag 12 described in conjunction with each embodiment of the bag and integral tie structure, is representatively depicted as having non-gusseted side edge portions defined by only two plastic film layers which meet at an outer side edge of the bag. However, the bag could also be formed with gusseted side edges so that the side edge portions of the bag would be defined by four layers of plastic film material. In this case, the inner end portions of the tie elements could be welded to two of the plastic film layers which define the gusseted side edge portions—such two layers being defined by an edge portions of one of the outer side walls of the bag and the next adjacent gusset layer.

Any of the representative plastic film tie element embodiments 32, 50, 66, 82, 98 and 110 may be quickly and easily secured to the bag 12 during its fabrication in a continuous, high speed bag forming process which will now be described with reference to FIGS. 22 and 23 that schematically depict representative apparatus 130 for continuously forming the bags 1 and welding tie elements 32 thereto along a side portion thereof adjacent their upper ends.

In the bag forming apparatus 130, plastic film material is supplied to a suitable extruding die 132 and is heated therein while air is blown upwardly through the die. The upward flow of air through the die forms a vertically extending blown plastic film tube 134 which is fed at its upper end through a pair of flattening rollers 136, 138 which flatten the tube 134 and forms therefrom a flattened film tube 140. The flattened tube 140 is pulled by drive rollers 142, 144 sequentially around guide rollers 146 and 148, through a suitable imprinter 150 used to form on the flattened tube 140 desired logos or other advertising indicia, and through a spaced apart pair of idler roller sets 152, 154 and 156, 158 As the flattened film tube 140 exits the drive rollers 142, 144 it is fed into a suitable packaging station 160 which packages in a desired fashion the bag and integral tie element structures formed by the apparatus 130 on the flattened film tube 140 in a manner subsequently described.

Positioned between the idler roller sets 152, 154 and 156, 158 is a cutting and welding station 162 which comprises a stationary anvil member 164 positioned beneath the flattened film tube 140, and a vertically reciprocable welding and cutting die element 166 aligned with the anvil 164 and positioned above the flattened film tube. The cutting and welding die 166 is provided along its lower face with an elongated heat welding element 168 and an elongated perforated cutline die 170 which is parallel thereto. As the flattened film tube 140 is longitudinally conveyed in a rightward direction, the cutting and welding die element 166 is caused to intermittently reciprocate to periodically press the flattened film tube 140 against the anvil 164 to form on the flattened film tube a longitudinally spaced series of adjacent lateral weld lines 26 and perforated cutlines 172. The weld lines 26 extend transversely between the side edges 28, 30 of the flattened film tube 140 and form the bottom end-closing weld lines on the illustrated individual bags 12*a*, 12*b* and 12*c* (see FIG. 1), while the perforated cutlines 172 define the bottom end 24 of one bag and the upper end 14 of an immediately adjacent bag in the series of bags being continuously formed by the apparatus 130.

Figure 23:
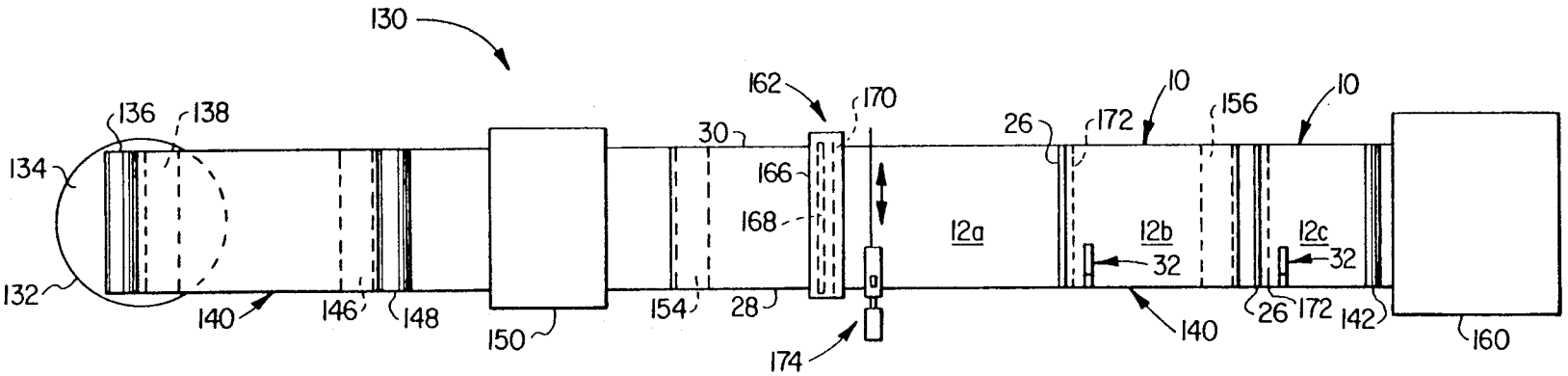
FIG. 23 is a schematic top plan view of the apparatus of FIG. 22.
Figure 22:
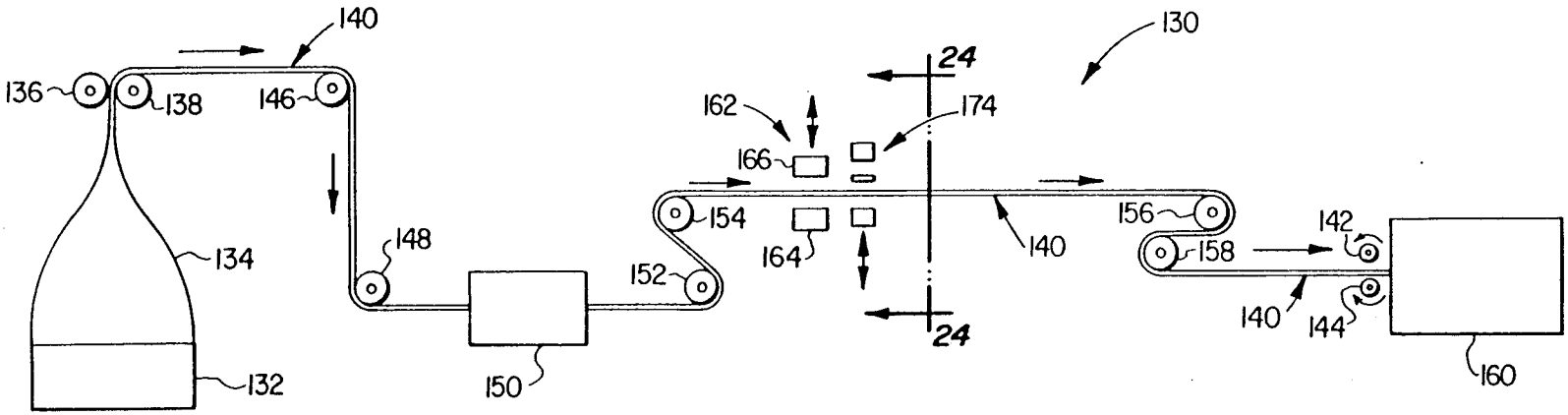
FIG. 22 is a schematic side view of representative apparatus utilized to continuously form a series of plastic bags and integral plastic film tie element similar to the bag and integral tie element illustrated in FIG. 1.
Figure 24:
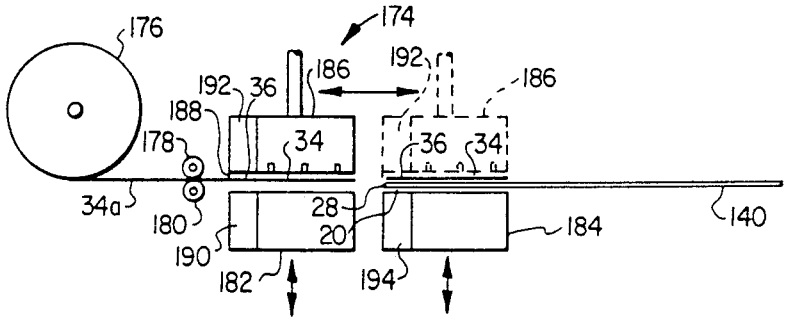
FIG. 24 is a schematic cross-sectional view through the apparatus taken along line 24—24 of FIG. 22 and illustrates apparatus used to secure to the bags tie elements similar to the tie element illustrated in FIG. 3.

Referring now to FIGS. 22–24, positioned downstream from the cutting and welding station 162 between the idler roller sets 152, 154 and 156, 158 is a tie element attachment station 174 which is adjacent the outer side edge 28 of the flattened film tube 140 and its associated outer side edge portion 20 defined by two layers of plastic film. As will be appreciated by reference to previously described drawing figures, the side edge 28 and the outer side edge portion 20 of the flattened film tube 140 define in each of the finished bags the similarly numbered side edge and outer side edge portion of the bag.

The tie element attachment station 174 includes a supply roll 176 of the plastic film strip material 34*a*, an opposed pair of feed rollers 178 and 180, a stationary anvil 182 positioned laterally outwardly from and slightly below the flattened film tube side edge 28, a vertically reciprocable heating and pressing element 184 positioned beneath the flattened film tube 140 adjacent its side edge 28, and a vacuum shuttle member 186 positioned above the flattened film tube 140 and horizontally reciprocable between its solid line and dotted line position in which the shuttle is respectively aligned with and positioned above the anvil 182 and the heating and pressing element 184.

As the flattened film tube 140 is being longitudinally conveyed toward the packaging station 160, the feed rollers 178, 180 pull a length of the strip material 34*a* from the roll 176 corresponding to the length of the tie element 32 and feed it rightwardly onto the upper surface of the anvil 182. The shuttle 186 is then moved from its dotted line position to its solid line position over the anvil 182 and the anvil 182 is moved upwardly to press the delivered length of strip material 34*a* against the undersurface of the shuttle 186. This causes a knife element 188 on the outer end of the shuttle 186 to sever the strip segment 34 from the balance of the rolled strip supply 34*a*. It also causes aligned heating portions 190 and 192 in the anvil 182 and the shuttle 186 to preheat the strip end portion 36.

The holding vacuum in the shuttle 186 is then suitably energized to hold the strip 134 to the underside of the shuttle which is then moved rightwardly to its dotted line position, carrying the strip 34 with it. The anvil 182 is then lowered to its initial position. When the shuttle 186 reaches its dotted line position, the movement of the flattened film tube is temporarily halted and the heating and pressing element 184 is moved upwardly to press an outer lateral portion of the flattened film tube 140 between the elements 184 and the shuttle 186. With the elements 184 and 186 in this position, the shuttle heating element 192 and a horizontally aligned heating element 194 weld the preheated end portion 36 of the strip 34 to the outer side edge portion of the flattened film tube 140, thereby weldingly intersecuring the two layers of the outer side edge portion 20 and the preheated strip end portion 36. After this welding process is complete, the heating and pressing element 184 is lowered and the flattened film tube 140 (which was temporarily stopped during this tie element attachment process) is again moved toward the packaging station 160. When the appropriate tie element location on the next successive bag is brought into alignment with the attachment station 174, the flattened film tube 140 is stopped again and the next successive tie element is welded to the flattened film tube as just described.

Figure 25:
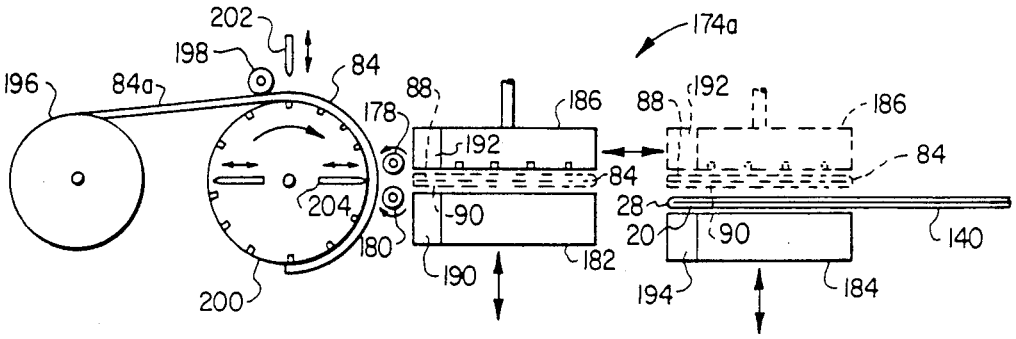
FIG. 25 is a cross-sectional view similar to that in FIG. 24 but illustrating apparatus utilized to secure to the bags tie elements of the type depicted in FIG. 12.

An alternate embodiment 174*a* of the tie element attachment station is schematically depicted in FIG. 25 and is utilized to attach to the individual bags the looped tie element 82 depicted in FIG. 12. The station 174*a* includes the anvil 182, the heating an pressing element 184, and the vacuum shuttle 186 (from which the cutting knife 188 is removed). During operation of the station 174*a*, a length of plastic film strip 84*a* is fed from a supply roll 196 thereof beneath a holding roller 198 onto the outer peripheral surface of a rotatable vacuum holding wheel 200 whose internal vacuum holds the strip $84_a$ thereon as the wheel rotates. The outer circumference of the wheel is sized so that half of such circumference is equal to the desired total length of the strip 84 depicted in FIG. 12. When the wheel 200 is rotated one half revolution in a clockwise direction, a knife element 202 is moved downwardly into engagement with the wheel 200 to sever the film strip 84 from the coiled strip supply 84*a*. After the strip 84 is severed, an internal pusher element 204 is moved radially outwardly through the wheel to push a longitudinal central portion of the severed strip 8 into the feed rollers 178, 180 which then feed the strip 84, in the desired doubled over configuration, onto the anvil 182. The shuttle 186 is then moved leftwardly from its dotted line position to its solid line position over the folded strip 84 and the anvil 182 is moved upwardly to press the strip 84 against the shuttle. At this point the anvil and shuttle heating elements 190. 192 preheat and weld together the aligned outer strip end portions 88, 90. The shuttle 186 is then moved rightwardly to its dotted line position, carrying the preheated strip 84 with it. The heating and pressing element 184 is then moved upwardly to cause the heating elements 192 and 194 to weldingly intersecure the preheated strip end portions 88, 90 and the two film layers of the outer side edge portion 20 of the flattened film tube 140.

Figure 26:
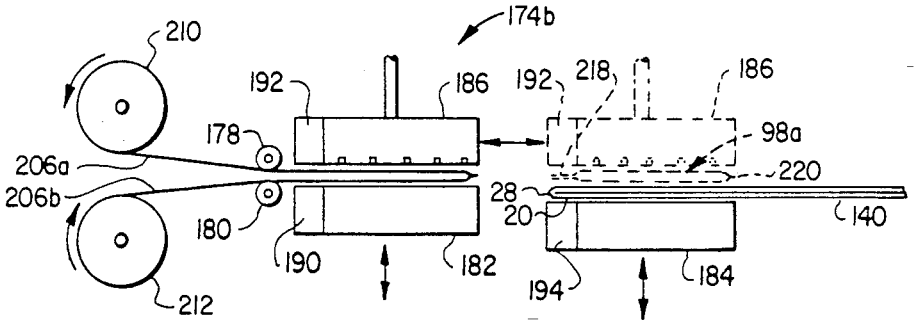
FIG. 26 is a cross-sectional view similar to that in FIG. 24 but illustrating apparatus for securing to the bags a modified version of the tie element illustrated in FIG. 12.
Figure 27:
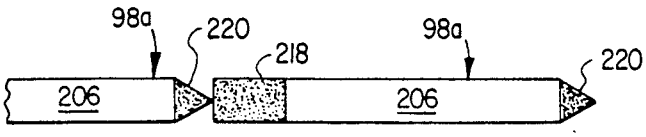
FIG. 27 is a top plan view of the tie elements formed by the apparatus of FIG. 26 and secured to the bags.
Figure 28:
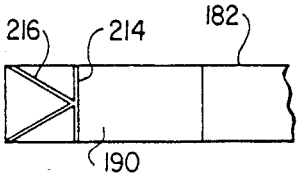
FIG. 28 is an enlarged top plan view of a lower heating and cutting die element portion of the apparatus of FIG. 26.

Schematically illustrated in FIG. 26 is a further alternate embodiment 174*b* of the tie element attachment station which is utilized to form and secure to each of the bags 12 a modified version 98*a* (FIG. 27) of the looped tie element 98 shown in FIG. 15. The station 174*b* includes the anvil 182, the heating and pressing element 184, the vacuum shuttle 186, and the drive rollers 178, 180. During operation of the station 174*b*, the feed rollers 178, 180 simultaneously feed lengths of plastic film strip material 206*a* and 206*b* from supply rolls 210, 212 thereof onto the anvil 182. The upper film strip 206*a* is of a relatively stiff plastic film material such as high density polyethylene, while the lower film strip 206*b* is of a more flexible (but more easily weldable) material such as ethyl vinyl acetate. After the two lengths of the upper and lower film strip material 206*a* and $206_b$ have been moved onto the anvil 182, the anvil is moved upwardly to press the laterally aligned film strip segments against the shuttle 186 in its leftwardly extended position. As illustrated in FIG. 28, the upper surface of the heating portion 192 of the anvil 182 is provided with a transversely extending knife element 214 positioned generally intermediately along the heating area 190, and a V-shaped knife element 216 which is positioned to the left of the knife element 214 and has a point portion closely adjacent thereto.

Each upward stroke of the anvil heater portion 190 forms on the stacked film strips between the anvil and the shuttle a generally rectangular welded area 218 on a trailing end portion of the strip segments, and a generally triangularly shaped welded area 220 on the leading ends of such strip segments. As aligned lengths of the film strips 206*a* and 206*b* are intermittently fed onto the anvil 182 and pressed against the shuttle 186, it can be seen that successive tie elements 98*a* are formed, the successive tie elements being separated by the knife element 214 at the juncture between the leading end welded area 220 of one of the tie elements and the trailing end welded area 218 on the tie element immediately adjacent thereto.

It can be seen that the cooperative action between the anvil 182 and the shuttle 186 not only forms this juncture area 218, 220 between successive tie elements 98*a*, but also preheats and welds the end portion 218 of each tie element 98*a* so that when the shuttle 186 carries the element 98*a* rightwardly to position it over the flattened film tube 140, and the heating and pressing element 184 is moved upwardly, the heating elements 192 and 194 may more easily weldingly intersecure the preheated strip area 218 and the two plastic film layers which define the outer edge portion 20 of the flattened film tube 140 adjacent the upper end of each bag being formed. The positioning of the ethyl vinyl acetate film strip segment immediately adjacent the upper surface of the flattened film tube 140 further facilitates this welding process. To form the slit 100 depicted in FIG. 15, a suitable knife element (not shown) may be secured to the upper side of the heating element 194. The pointed weld area 220 on the leading end of the tie element 98*a* facilitates the insertion of its free end portion into and through the slit 100.

Figure 29:
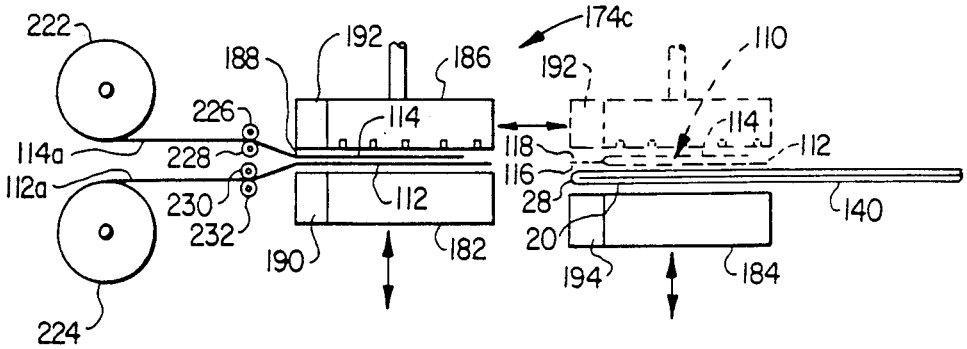
FIG. 29 is a cross-sectional view similar to that in FIG. 24 but illustrating apparatus used to secure to the bags tie elements of the type shown in FIG. 18.

Referring now to FIG. 29, a further alternate embodiment 174*c* of the tie element attachment station may be utilized to form the dual strip tie element embodiment 110 depicted in FIG. 18. In this station embodiment, lengths of upper and lower plastic film strip material 114*a*, 112*a* are respectively pulled from supply rolls 222, 224 thereof by feed roller sets 226, 228 and 230, 232 and fed onto the anvil 182. The lower feed roller set 230, 232 is operated at a slightly higher speed than the upper feed roller set 226, 228 so that when upper and lower strip segments 114, 112 are fed onto the anvil 182, the lower strip segment 112 projects rightwardly beyond the upper strip segment 114. This permits the vacuum shuttle 186 to catch both the lower and upper strip segments 112, 114 and carry them to above the flattened film tube 140.

As the anvil 182 is brought upwardly against the shuttle 186, a knife element 188 on the shuttle severs the upper and lower strip segments 114, 112, and the heating elements 190, 192 preheat and weld together the strip end portions 116 and 118. The shuttle 186 then carries the preheated tie element 110 to above the flattened film tube 140 whereupon the heating and pressing element 184 is moved upwardly to weld the outer side edge portion 20 to the preheated and welded end portion area of the tie element 110. The slit 122 and the tie element 110 (FIG. 18) is formed by a knife element (not shown) suitably positioned on the heating element 194. If desired, the coiled film strips 114*a* and 112*a* may be respectively formed from the previously described high density polyethylene and more flexible ethyl vinyl acetate materials to facilitate both the welding process and the ability of the tie element 110 to hold its associated bag in a closed position.

Figure 30:
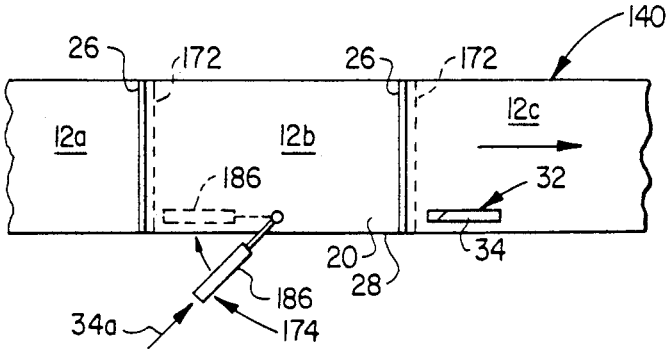
FIG. 30 is a schematic top plan view of a portion of the apparatus illustrated in FIG. 23 and depicts apparatus used to secure to the bags tie elements oriented relative to the bags as depicted in FIG. 21.

To connect, for example, the tie elements 32 to their associated bags 12 so that the tie element extends parallel to the bag side edge 28, the tie element attachment station 174 is modified so that the shuttle 186 is pivotable between its solid and dotted line positions depicted in FIG. 30. In its solid line position, the shuttle 186 is disposed over its associated anvil 182 onto which the plastic film strips 34 are fed as previously described. When the shuttle picks up the preheated and severed film strip 34, it is simply pivoted to its dotted line position over the flattened film tube 140 adjacent its side edge 28. The heating and pressing element 184 is then moved upwardly toward the pivotally repositioned shuttle to operate therewith to weld the tie element 32 to its associated bag 12.

In each of the previously described embodiments of the tie element attachment station 174, a two step process was used to form and preheat the tie elements and then move the formed and preheated tie elements into welding position and then weld the tie elements to their associated bags. If desired, however, these tie element forming and welding steps may be simultaneously performed as will now be described with initial reference to FIG. 31 which depicts a further embodiment 174$_d$ of the tie element attachment station. For purposes of illustration, the simultaneous formation and welding to the flattened film tube 140 of a single strip tie element 32 (FIG. 3) will be described.

The station 174$_d$ includes an elongated receiving channel member 234 which has an open bottom area and is positioned over the flattened film tube 140. Channel 234 extends transversely to the flattened tube 140 and has a left end 236 positioned immediately to the right of the side edge portion 20 of the flattened tube. Operatively connected to the upper side of the channel 234, and communicating with its interior, is a vacuum holding element 238. Connected to the left end of the holding element 238, and overlying the edge portion 20, is a heating element 240. Heating element 240 is aligned with a vertically reciprocable heating element 242 positioned beneath the side edge portion 20.

During operation of the attachment station 174*d*, the feed rollers 178, 180 feed a length of the plastic film strip 34*a* from its supply roll 176 toward the receiving channel 234. A jet of air 244 formed by a small nozzle member 246 is flowed between the rightwardly moving strip 34*a* exiting the feed rollers and the undersurfaces of the holding element 230 and the heating element 240 to create a relatively low pressure area above the rightwardly moving strip, thereby holding it relatively close to the upper side of the channel 234 as it advances toward the right end of the channel.

When the strip segment 34 reaches the right end of the channel 234, the nozzle 246 is deactivated and a vacuum is formed within the member 238 to hold the strip segment 34 against it. The lower heating element 240 is then moved upwardly to cause a knife element 248 thereon to sever the film strip 34 and, in cooperation with the upper heating element 240, to simultaneously weld the severed strip 34 to the side edge portion 20 of the flattened film tube 140, thereby operatively positioning the tie element 32 thereon.

Figure 31:
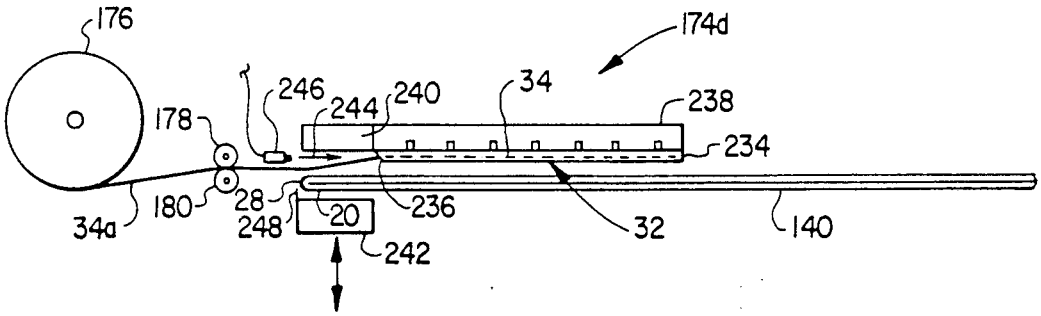
FIG. 31 is a cross-sectional view similar to that in FIG. 24 and illustrates alternate apparatus for securing to the bags tie elements of the type depicted in FIG. 3.
Figure 32:
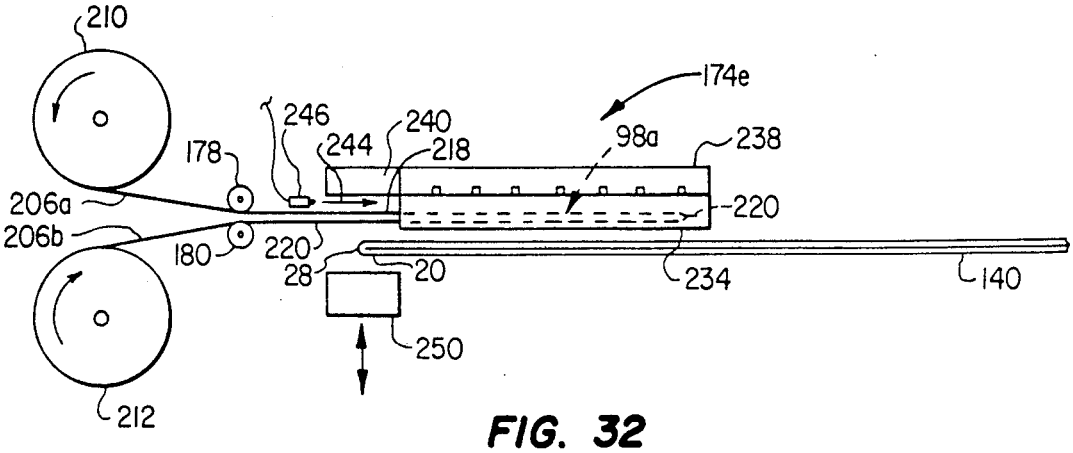
FIG. 32 is a cross-sectional view similar to that in FIG. 24 and illustrates alternate apparatus for securing to the bags tie elements similar to those illustrated in FIG. 27.

As another example of this in situ formation of and welding to one of the bags of a tie element, a looped tie element 98*a* (FIG. 27) may be secured to each of the bags by means of a slightly modified version 174*e* (FIG. 32) of the in situ tie-forming and welding apparatus depicted in FIG. 31. In the apparatus 174*e* the lower heating element 242 is replaced with a heating and cutting element 250 similar in configuration and operation to the anvil heating portion 190 of FIG. 28. In this embodiment, the portion of the element 250 containing the V-knife cutting segment is offset outwardly from the side edge 28 of the flattened film tube 140. After the feed rollers 178, 180 have fed appropriate lengths of the film strips 206*a* and 206*b* from their supply rolls 210, 212 into the receiving channel 234, the heating and cutting element 250 is moved upwardly against the upper heating element 240 to simultaneously sever the lead tie element 98*a* from its supply strip portions, weld the inner end portion to a teen of the tie element 98*a* to the outer edge portion 20 of the flattened film tube 140, and form the triangularly shaped welded outer end portion 220 of the next successive tie element 98*a*.

It can be seen from the foregoing that the present invention provides methods for forming a variety of alternatively configured plastic film tie elements, and for rapidly and very securely welding the tie elements to the side edge portion 20 of the longitudinally conveyed flattened film tube 140 at positions adjacent what will be the upper ends of the sequentially formed individual bags 12. These various representative methods of attaching the tie elements to the individual plastic film bags permit the maintenance of the necessary high speed, high volume bag production necessary to economically produce the bags 12. The relatively simple mechanisms used to feed, form and weld the tie elements do not substantially increase the finished cost of the bag and integral tie element structures compared to the cost of the bags themselves. Accordingly, the present invention advantageously and relatively inexpensively provides a disposable plastic film bag which may be easily and more conveniently closed than conventional bags of this general type having separate tie elements which are easily lost, or attached tie members of more complex construction.

The foregoing detailed description is to be clearly understood as being given by way of illustration and example only, the spirit and scope of the present invention being limited solely by the appended claims.

What is claimed is:

1. A method of continuously forming plastic film bags having integral, ready-to-use top tie elements, said method comprising the steps of:

longitudinally conveying an elongated plastic film element at least partially defined by a duality of opposed plastic film sheets extending across the width of said plastic film element;

delimiting on the plastic film element a series of individual bags by forming cut lines and weld lines thereon, each of said bags having an upper end, a pair of side edge portions defined by a plurality of plastic film layers, and a pair of opposite side walls extending between said side edge portions; forming from a relatively limp plastic material a series of elongated closure tie elements having a relatively large inner end portion including an inner end edge of said tie element, a free outer end portion, and a longitudinally intermediate portion extending between said inner and outer end portions;

delivering and positioning one of said series of elongated plastic tie elements with said large inner end portion, including a section thereof closely adjacent said inner end edge placed in an abutting and laterally overlapping relationship with a side surface of one of said side edge portions of said bag adjacent the upper end portion of each bag with the relatively large end portion positioned against at least two film layers of a side edge portion of each bag; and weldingly intersecuring the relatively large inner end portion area of each of the series of elongated plastic film tie elements and at least two film layers of side edge portions of each of the bags adjacent their upper ends to leave on each plastic film tie element a free outer end portion, whereby the free outer end portion of the tie element on each bag may be looped around an upper end portion of the bag, passed through the loop and then firmly pulled to constrict around, frictionally engage and tightly close such upper end portion, without separating the welded inner end portion of the tie element from its bag.

2. The method of claim 1 wherein:

said step of longitudinally conveying is performed utilizing an elongated section of flattened plastic film tubing.

3. A plastic bag and integral tie element structure formed by the method of claim 2.

4. The method of claim 1 wherein:

said step of weldingly intersecuring is performed subsequent to said delimiting step.

5. A plastic bag and integral tie element structure formed by the method of claim 4.

6. The method of claim 1 wherein:

said plastic film element has a pair of opposite side edge portions which define said opposite side edge portions of said plastic film bags.

7. A plastic bag and integral tie element structure formed by the method of claim 6.

8. A plastic bag and integral tie element structure formed by the method of claim 1.

9. The method of claim 1, wherein said delimiting step is performed subsequent to said weldingly intersecuring step.

10. The method of claim 8 wherein:

said forming step is performed prior to said weldingly intersecuring step, and said method further comprises the step, performed between said forming and weldingly intersecuring steps, of moving the elongated tie elements from forming positions to welding positions.

11. The method of claim 8 wherein:

said forming said weldingly intersecuring steps are performed essentially simultaneously.

12. The method of claim 8 further comprising the step of preheating said relatively large end portion areas of the elongated closure tie elements prior to performing said weldingly intersecuring step.

13. The method of claim 1 wherein:

said forming and weldingly intersecuring steps are performed essentially simultaneously.

14. The method of claim 1 further comprising the step of:

preheating said relatively large end portion areas of the elongated closure tie elements prior to performing said weldingly intersecuring step.

15. A method of continuously forming plastic film bags having integral, ready-to-use top tie elements, said method comprising the steps of:

longitudinally conveying an elongated plastic film element at least partially defined by a duality of opposed plastic film sheets extending across the width of said plastic film element;

delimiting on the plastic film element a series of individual bags by forming cut lines and weld lines thereon, each of said bags having an upper end, a pair of side edge portions defined by a plurality of plastic film layers, and a pair of opposite side walls extending between said side edge portions;

weldingly intersecuring the relatively large end portion area of one of a series of elongated plastic film tie elements and at least two film layers of side edge portions of each of the bags adjacent their upper ends to leave on each plastic film tie element a free outer end portion, whereby the free outer end portion of the tie element on each bag may be looped around an upper end portion of the bag, and then firmly pulled to tightly close such upper end portion, without separating the welded end portion of the tie element from its bag; and said method further comprising the step of forming an aperture through each of said relatively large end portion areas of said tie elements, and the film layers intersecured therewith, each of said apertures being sized to permit its associated tie element free end portion to be passed therethrough.

16. The method of claim 15 wherein:

said method further comprises the step of configuring each of said apertures in a manner causing it to inhibit withdrawal therethrough of its associated tie element free end portion once such free end portion has initially been inserted in and pulled through the aperture.

17. The method of claim 16 wherein:

each of said elongated plastic film tie elements has a transverse width, and said step of forming an aperture is performed by forming an elongated slit through each of said relatively large end portion areas of said tie elements and the film layers intersecured therewith, each of said slits having a length less than the width of its associated tie element free end portion.

18. A plastic bag and integral tie element structure formed by the method of claim 17.

19. A plastic bag and integral tie element structure formed by the method of claim 16.

20. A plastic bag and integral tie element structure formed by the method of claim 15.

21. A high speed, continuous method of forming plastic bags with integral top tie elements, said method comprising the steps of:

longitudinally conveying an elongated plastic film element through bag forming apparatus adapted to form therefrom a series of individual plastic film bags, said plastic film element having opposite side edge portions each defined by a plurality of plastic film layers, said opposite side edge portions of said plastic film elements defining opposite side edge portions in each of the individual bags in said series thereof;

feeding lengths of plastic film strip material from at least one supply roll thereof;

successively severing said lengths of plastic film strip material from said at least one supply roll;

sequentially weldingly intersecuring relatively large end portion areas of the severed lengths of plastic film strip material to at least two plastic film layers of one of said side edge portions of said plastic film element at longitudinally spaced positions thereon adjacent locations corresponding to the upper ends of the finished individual bags to thereby provide each of the finished bags with a plastic top tie element secured at one end thereof to the bag along a relatively large multilayer weld area disposed on a side edge portion of the bag adjacent its upper end, each of said tie elements having an elongated free outer end portion extending outwardly from its associated multi-layer weld area; and forming an aperture through each of said multi-layer weld areas, each of said apertures being configured to permit its associated tie element free end portion to be passed therethrough.

* * * * *

UNITED STATES PATENT AND TRADEMARK OFFICE

CERTIFICATE OF CORRECTION

PATENT NO. : 5,045,042

DATED : September 3, 1991

INVENTOR(S) : Gary L. Rutledge

It is certified that error appears in the above-identified patent and that said Letters Patent is hereby corrected as shown below:

On page 1, line 5 of the abstract, delete the word "suitable" and add the word --suitably--.

Col 1, line 29, delete "-" after the word "and".

Col. 5, line 17, delete "," after the word "is".

Col. 10, line 9, delete the number "1" and add the number --12--.

Col. 12, line 5, delete the number "8" and add the number --84--.

Col. 16, line 19, delete the number "8" and add the number --9--.

Col. 16, line 26, delete the number "8" and add the number --9--.

UNITED STATES PATENT AND TRADEMARK OFFICE

CERTIFICATE OF CORRECTION

PATENT NO. : 5,045,042

DATED : September 3, 1991

INVENTOR(S) : Gary L. Rutledge

It is certified that error appears in the above-identified patent and that said Letters Patent is hereby corrected as shown below:

Col. 16, line 29, delete the number "8" and add the number --9--.

Signed and Sealed this

Twelfth Day of January, 1993

*Attest:*

DOUGLAS B. COMER

*Attesting Officer*

*Acting Commissioner of Patents and Trademarks*